US010477908B2

(12) United States Patent
Okamoto et al.

(10) Patent No.: US 10,477,908 B2
(45) Date of Patent: Nov. 19, 2019

(54) ACRYLIC FIBER FOR ARTIFICIAL HAIR, METHOD FOR PRODUCING SAME, AND HEAD DECORATION PRODUCT COMPRISING SAME

(71) Applicant: Kaneka Corporation, Osaka (JP)

(72) Inventors: Akihiro Okamoto, Hyogo (JP); Aki Kano, Hyogo (JP); Masato Fujita, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 45 days.

(21) Appl. No.: 15/717,280

(22) Filed: Sep. 27, 2017

(65) Prior Publication Data

US 2018/0014594 A1 Jan. 18, 2018

Related U.S. Application Data

(63) Continuation of application No. PCT/JP2016/059669, filed on Mar. 25, 2016.

(30) Foreign Application Priority Data

Mar. 30, 2015 (JP) ..... 2015-069527

(51) Int. Cl.

| | |
|---|---|
| ***A41G 5/00*** | (2006.01) |
| ***A41G 3/00*** | (2006.01) |
| ***D01D 5/04*** | (2006.01) |
| ***D01D 5/06*** | (2006.01) |
| ***D01D 5/38*** | (2006.01) |
| ***D01F 6/40*** | (2006.01) |
| ***D01F 6/38*** | (2006.01) |
| ***D01F 11/06*** | (2006.01) |

(52) U.S. Cl.

CPC ..... *A41G 5/004* (2013.01); *A41G 3/0083* (2013.01); *D01D 5/04* (2013.01); *D01D 5/06* (2013.01); *D01D 5/38* (2013.01); *D01F 6/38* (2013.01); *D01F 6/40* (2013.01); *D01F 11/06* (2013.01); *A41G 3/00* (2013.01); *A41G 5/0006* (2013.01); *D10B 2321/101* (2013.01); *D10B 2503/08* (2013.01)

(58) Field of Classification Search

CPC ... A41G 5/00; A41G 3/00; D01D 5/06; D01D 5/04; D01D 5/38

USPC ..... 524/167

See application file for complete search history.

(56) References Cited

U.S. PATENT DOCUMENTS

| | | | | |
|---|---|---|---|---|
| 2,723,900 | A | 11/1955 | Hooper | |
| 3,324,215 | A | 6/1967 | Rosembaum et al. | |
| T958,007 | I4 | 5/1977 | Roberts | |
| 2004/0074509 | A1* | 4/2004 | Murata | D01F 6/38 132/201 |
| 2004/0170835 | A1* | 9/2004 | Takeuchi | D01F 6/54 428/393 |
| 2007/0021543 | A1 | 1/2007 | Masuda | |
| 2007/0190322 | A1 | 8/2007 | Harada | |
| 2009/0243143 | A1 | 10/2009 | Zhang et al. | |
| 2009/0266372 | A1 | 10/2009 | Higami et al. | |
| 2011/0120484 | A1 | 5/2011 | Matsumoto et al. | |
| 2011/0196091 | A1 | 8/2011 | Zhang et al. | |
| 2011/0271976 | A1 | 11/2011 | Sasayama | |
| 2014/0109924 | A1 | 4/2014 | Horihata | |
| 2018/0116322 | A1* | 5/2018 | Tanaka | A41G 3/0083 |

FOREIGN PATENT DOCUMENTS

| | | | |
|---|---|---|---|
| EP | 1367153 | A1 | 12/2003 |
| EP | 2123805 | A1 | 11/2009 |
| EP | 2329733 | A1 | 6/2011 |
| EP | 3222760 | A1 | 9/2017 |
| EP | 3315038 | A1 | 5/2018 |
| GB | 1308728 | A | 3/1973 |
| JP | H04-245972 | A | 9/1992 |
| JP | H04-263637 | A | 9/1992 |
| JP | H06-073609 | A | 3/1994 |
| JP | 2000-119972 | A | 4/2000 |
| JP | 2002-227018 | A | 8/2002 |
| JP | 2002-227028 | A | 8/2002 |
| JP | 2002-249914 | A | 9/2002 |
| JP | 2002-315765 | A | 10/2002 |
| JP | 2003-328222 | A | 11/2003 |
| JP | 2008-75210 | A | 4/2008 |
| JP | 4128024 | B2 | 7/2008 |
| JP | 4191930 | B2 | 12/2008 |
| JP | 4203096 | B2 | 12/2008 |
| JP | 2009-138314 | A | 6/2009 |
| JP | 2010-512469 | A | 4/2010 |
| JP | 2011-252251 | A | 12/2011 |
| JP | 2012-111855 | A | 6/2012 |
| JP | 5105871 | B2 | 12/2012 |
| JP | 5122133 | B2 | 1/2013 |
| JP | 5176960 | B2 | 4/2013 |
| JP | 5492779 | B2 | 5/2014 |
| JP | 2015-067925 | A | 4/2015 |
| WO | 2012/043348 | A1 | 4/2012 |
| WO | 2012/157561 | A1 | 11/2012 |

OTHER PUBLICATIONS

Office Action issued in U.S. Appl. No. 15/851,022, dated Feb. 1, 2019 (8 pages).

Extended European Search Report issued in European Application No. 16772654.6, dated Oct. 18, 2018 (8 pages).

International Search Report issued in International Application No. PCT/JP2016/068683; dated Sep. 20, 2016 (2 pages).

(Continued)

*Primary Examiner* — Deve E Valdez

(74) *Attorney, Agent, or Firm* — Osha Liang LLP

(57) ABSTRACT

An acrylic fiber for artificial hair includes an acrylic polymer and an organic solvent that can dissolve the acrylic polymer, wherein the acrylic polymer includes 29.5 to 79.5% by weight of acrylonitrile, 20 to 70% by weight of vinyl chloride and/or vinylidene chloride, and 0.5 to 5% by weight of a sulfonic acid-containing vinyl monomer with respect to a total weight of the acrylic polymer, and wherein a content of the organic solvent in the acrylic fiber is 0.1 to 3% by weight.

8 Claims, No Drawings

(56) References Cited

OTHER PUBLICATIONS

Restriction Requirement issued in U.S. Appl. No. 15/851,022, dated Nov. 20, 2018 (9 pages).
International Search Report issued in International Application No. PCT/JP2016/059669; dated Jun. 21, 2016 (2 pages).

* cited by examiner

ACRYLIC FIBER FOR ARTIFICIAL HAIR, METHOD FOR PRODUCING SAME, AND HEAD DECORATION PRODUCT COMPRISING SAME

TECHNICAL FIELD

One or more embodiments of the present invention relate to an acrylic fiber for artificial hair, a method for producing the same, and a hair ornament product including the same. More specifically, one or more embodiments of the present invention relate to an acrylic fiber for artificial hair having favorable curl setting properties with hot water, a method for producing the same, and a hair ornament product including the same.

BACKGROUND ART

Conventionally, acrylic fibers have been used as fibers for artificial hair because their feel, gloss, and voluminousness are similar to those of human hair. For example, Patent Document 1 proposes fibers for artificial hair that are acrylic synthetic fibers composed mainly of a copolymer containing 35 wt % or more of acrylonitrile and a vinyl monomer copolymerizable with the acrylonitrile such as vinyl chloride or vinylidene chloride. Patent Document 2 proposes synthetic fibers for artificial hair that are made from an acrylonitrile polymer containing 30 to 80 wt % of acrylonitrile and 20 to 70 wt % of vinyl chloride and/or vinylidene chloride.

PRIOR ART DOCUMENTS

Patent Documents

Patent Document 1: JP 2003-328222 A
Patent Document 2: WO 2012/043348

However, acrylic fibers produced by spinning an acrylic polymer that is prepared by copolymerizing acrylonitrile and vinyl chloride and/or vinylidene chloride, in particular, acrylic fibers produced by spinning a spinning solution that is prepared by dissolving an acrylic polymer in an organic solvent (e.g., dimethylsulfoxide), have poor curl setting properties with hot water. Patent Document 1 seeks improvements in opacity, but is silent as to the curl setting properties with hot water. Patent Document 2 seeks improvements in combing and styling properties, but is silent as to the curl setting properties with hot water.

SUMMARY

One or more embodiments of the present invention provide an acrylic fiber for artificial hair having favorable curl setting properties with hot water, a method for producing the same, and a hair ornament product including the same.

One or more embodiments of the present invention relate to an acrylic fiber for artificial hair formed from an acrylic polymer. In one or more embodiments, the acrylic polymer contains 29.5 to 79.5% by weight of acrylonitrile, 20 to 70% by weight of vinyl chloride and/or vinylidene chloride, and 0.5 to 5% by weight of a sulfonic acid-containing vinyl monomer with respect to a total weight of the acrylic polymer. In one or more embodiments, the content of an organic solvent that can dissolve the acrylic polymer in the acrylic fiber is 0.1 to 3% by weight.

According to one or more embodiments of the present invention, the organic solvent that can dissolve the acrylic polymer may be at least one selected from the group consisting of acetone, dimethylsulfoxide, N,N-dimethylformamide, dimethylacetamide, dimethylsulfone, ε-caprolactam, ethylene carbonate, and sulfolane.

One or more embodiments of the present invention also relate to a method for producing an acrylic fiber for artificial hair with a spinning solution containing an acrylic polymer. In one or more embodiments, the acrylic polymer contains 29.5 to 79.5% by weight of acrylonitrile, 20 to 70% by weight of vinyl chloride and/or vinylidene chloride, and 0.5 to 5% by weight of a sulfonic acid-containing vinyl monomer with respect to a total weight of the acrylic polymer. The method includes: extruding the spinning solution through a spinning nozzle to form a yarn; drawing the yarn to prepare a primary drawn yarn and washing it with water; and impregnating the water-washed primary drawn yarn with an organic solvent that can dissolve the acrylic polymer so that a content of the organic solvent that can dissolve the acrylic polymer in the acrylic fiber is 0.1 to 3% by weight.

It is also envisioned that the impregnation of the water-washed primary drawn yarn with the organic solvent that can dissolve the acrylic polymer may be performed using a mixture of the organic solvent that can dissolve the acrylic polymer and a finishing oil.

In one or more embodiments of the present invention, the spinning solution may be obtained by dissolving the acrylic polymer in one organic solvent selected from the group consisting of acetone, dimethylsulfoxide, N,N-dimethylformamide, and dimethylacetamide. It is also envisioned that a yarn may be formed by extruding the spinning solution into a coagulation liquid through a spinning nozzle; and the yarn be subjected to primary drawing in an aqueous solution of the organic solvent used for the spinning solution.

One or more embodiments of the present invention also relate to a hair ornament product including the above acrylic fiber for artificial hair.

The hair ornament product may be one selected from the group consisting of a fiber bundle for hair, a weave, a wig, a braid, a toupee, a hair extension, and a hair accessory.

One or more embodiments of the present invention provide an acrylic fiber for artificial hair having favorable curl setting properties with hot water, a method for producing the same, and a hair ornament product including the same.

DETAILED DESCRIPTION OF THE EMBODIMENTS

One or more embodiments of the present invention improve the curl setting properties with hot water of acrylic fibers made from an acrylic polymer that is prepared by copolymerizing acrylonitrile, vinyl chloride and/or vinylidene chloride, and a sulfonic acid-containing vinyl monomer. The inventors of the present disclosure have found that acrylic fibers containing 0.1 wt % or more of an organic solvent that can dissolve the acrylic polymer may improve their curl setting properties with hot water. Generally, organic solvents in acrylic fibers are removed by water washing in the spinning stage. Surprisingly, acrylic fibers containing a predetermined amount of the organic solvent that can dissolve the acrylic polymer may improve the curl setting properties with hot water.

The acrylic polymer contains 29.5 to 79.5 wt % of acrylonitrile, 20 to 70 wt % of vinyl chloride and/or vinylidene chloride, and 0.5 to 5 wt % of a sulfonic acid-containing vinyl monomer with respect to the total weight of the acrylic polymer. In other words, the acrylic polymer is obtained by polymerizing 100 parts by weight in total of a monomer mixture containing 29.5 to 79.5 parts by weight of acrylonitrile, 20 to 70 parts by weight of vinyl chloride and/or vinylidene chloride, and 0.5 to 5 parts by weight of a sulfonic acid-containing vinyl monomer. When the content of the acrylonitrile in the acrylic polymer is 29.5 to 79.5 wt %, the heat resistance improves. When the content of the vinyl chloride and/or vinylidene chloride in the acrylic polymer is 20 to 70 wt %, the flame resistance improves. When the content of a sulfonic acid monomer in the acrylic polymer is 0.5 to 5 wt %, the hydrophilicity increases. The acrylic polymer may contain 34.5 to 74.5 wt % of acrylonitrile, 25 to 65 wt % of vinyl chloride and/or vinylidene chloride, and 0.5 to 5 wt % of a sulfonic acid-containing monomer with respect to the total weight of the acrylic polymer, or may contain 39.5 to 74.5 wt % of acrylonitrile, 25 to 60 wt % of vinyl chloride and/or vinylidene chloride, and 0.5 to 5 wt % of a sulfonic acid-containing monomer. The acrylic polymer may contain vinyl chloride from the viewpoint of improving the feel.

The sulfonic acid-containing monomer is not particularly limited, but examples of the same include allylsulfonic acid, methallylsulfonic acid, styrenesulfonic acid, isoprenesulfonic acid, 2-acrylamido-2-methylpropanesulfonic acid, and metal salts such as sodium salts thereof and amine salts thereof. These sulfonic acid-containing monomers can be used individually or in combination of two or more.

In the acrylic fiber for artificial hair, the content of the organic solvent that can dissolve the acrylic polymer (hereinafter, also referred to as an "organic solvent A") is 0.1 to 3 wt %. When the content of the organic solvent A in the acrylic fiber is within the above range, the curl setting properties with hot water improve while the spinnability increases. When the content of the organic solvent A in the acrylic fiber is less than 0.1 wt %, the curl setting properties with hot water cannot improve. When the content of the organic solvent A in the acrylic fiber exceeds 3 wt %, the curl retention properties may deteriorate and the spinnability may decrease, which results in fiber cut. The content of the organic solvent A in the acrylic fiber may be 0.2 wt % or more, or 0.25 wt % or more, or 0.3 wt % or more. At the same time, the content of the organic solvent A in the acrylic fiber may be 2.8 wt % or less, or 2.5 wt % or less, or 2 wt % or less. In one or more embodiments of the present invention, if a mixture prepared by adding 20 parts by weight of a predetermined organic solvent to 100 parts by weight of an acrylic polymer is heated at 90° C. for 30 minutes and the state thereafter is transparent, the organic solvent is judged as the "organic solvent that can dissolve the acrylic polymer". Examples of the organic solvent that can dissolve the acrylic polymer include acetonitrile, acetone, dimethylsulfoxide, N,N-dimethylformamide, dimethylacetamide, dimethylsulfone, ε-caprolactam, ethylene carbonate, and sulfolane.

The acrylic fiber for artificial hair is not particularly limited, but may contain, as the organic solvent A, at least one selected from the group consisting of acetone, dimethylsulfoxide, N,N-dimethylformamide, dimethylacetamide, dimethylsulfone, ε-caprolactam, ethylene carbonate, and sulfolane from the viewpoint of improving the feel and combing properties, or may contain at least one selected from the group consisting of dimethylsulfoxide, N,N-dimethylformamide, dimethylacetamide, dimethylsulfone, ε-caprolactam, ethylene carbonate, and sulfolane from the viewpoint of preventing vaporization of the organic solvent in a drying step, or may contain at least one selected from the group consisting of dimethylsulfoxide, dimethylsulfone, ε-caprolactam, ethylene carbonate, and sulfolane from the viewpoint of the safety to human bodies, or may contain at least one selected from the group consisting of dimethylsulfone, ε-caprolactam, ethylene carbonate, and sulfolane.

In one or more embodiments of the present invention, when the organic solvent A has a higher boiling point than water, the content of the organic solvent A in the acrylic fiber is measured and calculated as follows. Fibers are put in a glass sample bottle filled with pure water so that the water will not overflow, and left to stand for 2 hours or more in hot water at 95° C. or more. After extraction of the organic solvent in the fibers, the extract is analyzed with gas chromatography, etc., to measure a weight (W1) of the organic solvent in the fibers. The fibers in the glass sample bottle are washed with pure water, and dried in an atmosphere at 110° C. for 4 hours or more to measure a weight (W2) of the fibers after drying. The content of the organic solvent A in the acrylic fibers is calculated from the following formula.

$$\text{The content of the organic solvent } A \text{ in the acrylic fibers (wt \%)} = (W1)/(W2+W1)\times 100$$

In one or more embodiments of the present invention, when the organic solvent A has a lower boiling point than water, the content of the organic solvent A in the acrylic fiber is measured and calculated as follows. Fibers are put in an organic solvent that can dissolve the acrylic polymer (an organic solvent different from that in the fibers), and a polymer solution obtained by dissolution is analyzed with gas chromatography, etc., to measure a weight (W3) of the organic solvent in the fibers. Fibers having the same weight as the fibers dissolved in the organic solvent are dried in an atmosphere at 110° C. for 4 hours or more to measure a weight (W4) of the fibers after drying. The content of the organic solvent A in the acrylic fibers is calculated from the following formula.

$$\text{The content of the organic solvent } A \text{ in the acrylic fibers (wt \%)} = (W3)/(W4)\times 100$$

The acrylic fiber for artificial hair has an apparent glass transition temperature (apparent Tg) of 95° C. or below, or 90° C. or below, or 85° C. or below. When the apparent Tg of the fiber is within the above range, the curl setting properties with hot water improve, even with hot water at lower temperatures, e.g., at 60 to 70° C. In one or more embodiments of the present invention, the apparent Tg of the fiber means a peak temperature of tan δ. The peak temperature of tan δ is a temperature at which dynamic viscoelasticity (tan δ) becomes maximum. The dynamic viscoelasticity (tan δ) is determined by measuring a loss modulus (E") and a storage modulus (E') of the fiber in accordance with JIS K 7244 using a thermal analysis device and substituting the obtained values in the following formula.

$$\text{Dynamic viscoelasticity } (\tan\delta) = \text{Loss modulus } (E'')/\text{Storage modulus } (E')$$

The acrylic fiber for artificial hair according to one or more embodiments of the present invention is not particularly limited, but can be produced by extruding a spinning solution containing an acrylic polymer through a spinning nozzle to form a yarn (undrawn yarn); drawing the yarn to prepare a primary drawn yarn and washing it with water; and impregnating the water-washed primary drawn yarn with the organic solvent A so that the content of the organic solvent A in the acrylic fiber is 0.1 to 3 wt %.

The spinning solution is produced by dissolving the acrylic polymer in an organic solvent for spinning solution, and examples of the same include acetone, dimethylsulfoxide, N,N-dimethylformamide, and dimethylacetamide. The organic solvents A described above can be used as the organic solvent for spinning solution. The organic solvent for spinning solution may be one selected from the group consisting of dimethylsulfoxide, N,N-dimethylformamide, and dimethylacetamide from the viewpoint of easy desolvation, or may be dimethylsulfoxide (DMSO) from the viewpoint of safety.

Although depending on the composition of the acrylic polymer, the spinning solution may contain, e.g., 20 to 30 wt % of the acrylic polymer, or may contain 22 to 30 wt % of the acrylic polymer, or may contain 25 to 30 wt % of the acrylic polymer with respect to the total weight of the spinning solution. The spinning solution may contain a small amount of water, e.g., 1.5 to 4.8 wt % of water, with respect to the total weight of the spinning solution.

The spinning solution may contain other additives as needed to modify fiber characteristics, as long as the effects according to one or more embodiments of the present invention are not impaired. Examples of the additives include: gloss adjusters such as titanium dioxide, silicon dioxide, and esters and ethers of cellulose derivatives including cellulose acetate; colorants such as organic pigments, inorganic pigments, and dyes; and stabilizers for improving light resistance and heat resistance.

The spinning solution is subjected to wet spinning or dry spinning by a general method to form yarns. In the wet spinning, for example, the spinning solution is discharged through a spinning nozzle into a coagulation liquid (coagulation bath) containing an aqueous solution of the organic solvent used for the spinning solution so as to coagulate the spinning solution, whereby yarns (undrawn yarns) are formed. For the coagulation bath, for example, an aqueous solution of the organic solvent (e.g., DMSO) used for the spinning solution having an organic solvent concentration of 40 to 70 wt % may be used. The temperature of the coagulation bath may be at 5 to 40° C. If the solvent concentration of the coagulation bath is excessively low, coagulation proceeds too fast, which tends to create a rough coagulation structure and form voids inside the fibers.

Next, the undrawn yarns obtained are subjected to primary drawing by being introduced into a 30° C. or more aqueous solution of the organic solvent (e.g., DMSO) used for the spinning solution having a lower organic solvent concentration than the coagulation liquid, and subjected to a relaxation treatment after drawing as needed. Subsequently, the primary drawn yarns are washed with warm water at 30° C. or more. Alternatively, the undrawn yarns may be introduced into warm water at 30° C. or more, and subjected to the primary drawing and water washing simultaneously. Desolvation is performed through water washing. According to one or more embodiments of the present invention, the undrawn yarns may be subjected to primary drawing in an aqueous solution of the organic solvent (e.g., DMSO) used for the spinning solution having an organic solvent concentration of 30 to 60 wt %, and the primary drawn yarns obtained be washed with warm water at 30° C. or more, from the viewpoint of drawability and surface smoothness. The draw ratio of the primary drawing is not particularly limited, but may be 2 to 8 times, or 2 to 7 times, or 2 to 6 times, from the viewpoint of increasing the strength of the fibers and productivity.

Next, the water-washed primary drawn yarns are impregnated with the organic solvent A. Since the fibers are swelled by water washing, the organic solvent A is easily impregnated into the fibers. The molecular weight of the organic solvent A may be 300 or less, or 100 or less, from the viewpoint of easy impregnation of the fibers with the organic solvent A. The boiling point of the organic solvent A may be higher than that of water, or 120° C. or more, or 150° C. or more at 1 atmospheric pressure, from the viewpoint of preventing the vaporization of the organic solvent A in the drying step. The organic solvent A may be one selected from the group consisting of dimethylsulfoxide, N,N-dimethylformamide, dimethylacetamide, dimethylsulfone, ε-caprolactam, ethylene carbonate, and sulfolane from the viewpoint of a high boiling point and a low molecular weight, or may be selected from the group consisting of dimethylsulfoxide, dimethylsulfone, ε-caprolactam, ethylene carbonate, and sulfolane.

It is also envisioned that the impregnation of the water-washed primary drawn yarns with the organic solvent A may be performed using a mixture prepared by adding the organic solvent A to a finishing oil, from the viewpoint of easy operation and easy adjustment of the degree of impregnation with the organic solvent. In other words, the yarns are impregnated with the organic solvent A and a finishing oil simultaneously. The impregnation is not particularly limited, but may be performed by spraying a mixture of the organic solvent A and a finishing oil on the water-washed primary drawn yarns, or immersing the water-washed primary drawn yarns in a mixture of the organic solvent A and a finishing oil. Then, the acrylic fibers after impregnation with the organic solvent are dried. The drying temperature is not particularly limited, but may range from 110 to 190° C., or from 110 to 160° C., for example. The content of the organic solvent A in the acrylic fiber can be adjusted by appropriately selecting the impregnation method or the mixing ratio of the organic solvent A in the mixture of the organic solvent A and a finishing oil.

Any finishing oil that can be generally used for the purpose of preventing static electricity adhesion between fibers, or improving texture, may be used in the production of the fibers. Examples of the finishing oil include known oils, including: anionic surfactants such as phosphates and sulfates; cationic surfactants such as quaternary ammonium salts and imidazolium salts; nonionic surfactants such as ethylene oxide adducts and/or propylene oxide adducts of fats and oils, polyhydric alcohol partial esters; animal and vegetable fats and oils, mineral oils, and fatty acid esters; and silicone-based surfactants such as amino-modified silicones. The finishing oil can be used individually or in combination of two or more. Generally, the finishing oil is used in a state of being dissolved or dispersed in water (also called as "oil solution"). By adding a specific amount of the organic solvent A to the oil solution to impart the organic solvent A to the acrylic fibers together with the finishing oil, the fibers can contain the organic solvent A. Specifically, the organic solvent A may impart to the acrylic fibers by introducing a mixture of the oil solution and the organic solvent A to an oil tank and immersing the yarns after the water washing step in the oil tank. The temperature of the oil tank is not particularly limited, but may be 40° or more, or 40 to 80° C. The immersion time is not particularly limited, but may be 1 to 10 seconds, or 1 to 5 seconds. The content of the organic solvent A in the mixture of the organic solvent A and the oil solution may be 0.1 to 10 parts by weight, or 0.2 to 5 parts by weight, or 0.3 to 2 parts by weight with respect to 100 parts by weight of the oil solution, from the viewpoint of maintaining the stability of oil particles by mixing with the finishing oil and adjusting the optimum solvent content.

Secondary drawing may be performed as needed after impregnation with the organic solvent A and drying. The draw ratio of the secondary drawing may be 1 to 4 times.

The total draw ratio, which is a sum of the draw ratio of the primary drawing and that of the secondary drawing, may be 2 to 12 times.

Then, a 15% or more relaxation treatment may be performed. The relaxation treatment can be performed in a dry heat atmosphere or superheated steam atmosphere at high temperatures, e.g., at 150 to 200° C., or at 150 to 190° C. The relaxation treatment can also be performed in a pressurized steam atmosphere or heated and pressurized steam atmosphere at 120 to 180° C. under 0.05 to 0.4 MPa, or 0.1 to 0.4 MPa. This treatment can increase the knot strength of the fibers.

The single fiber fineness of the acrylic fiber may be 30 to 100 dtex, or 40 to 80 dtex, or 45 to 70 dtex, from the viewpoint of being suitably used as artificial hair.

The acrylic fiber for artificial hair has favorable curl setting properties with hot water (hereinafter, also referred to as "HWS properties" simply). For example, the acrylic fiber for artificial hair can be curled in hot water at 60 to 100° C. The method of the curl setting is not particularly limited, and may be determined appropriately depending on the purpose and intended use.

Examples of the method include twisting, winding using a metal cylinder (pipe winding), and net processing (YAKI processing).

A hair ornament product can be produced using the above acrylic fiber for artificial hair. The hair ornament product may include other fibers for artificial hair in addition to the artificial protein fiber for hair. Examples of the other fibers for artificial hair include, but are not particularly limited to, polyvinyl chloride fibers, nylon fibers, polyester fibers, and regenerated collagen fibers.

Examples of the hair ornament product include a fiber bundle for hair, a weave, a wig, a braid, a toupee, a hair extension, and a hair accessory.

EXAMPLES

Hereinafter, one or more embodiments of the present invention will be described in more detail by way of examples. However, the present invention is not limited to the following examples.

Example 1

An acrylic polymer consisting of 46 wt % of acrylonitrile, 52 wt % of vinyl chloride, and 2 wt % of sodium styrenesulfonate was dissolved in dimethylsulfoxide (DMSO) to prepare a spinning solution with a resin concentration of 28.0 wt % and a moisture concentration of 3.5 wt %. The spinning solution was extruded into a 20° C. coagulation bath containing 62 wt % of a DMSO aqueous solution using a spinning nozzle (pore diameter: 0.3 mm, the number of pores: 1250) and subjected to wet spinning at a spinning rate of 2 m/minute, followed by drawing to 3 times in a 80° C. drawing bath containing 50 wt % of a DMSO aqueous solution. Then, the primary drawn yarns were washed with warm water at 90° C. Next, the water-washed primary drawn yarns were immersed for 3 to 5 seconds in an oil bath (60° C.) to which a mixture of finishing oils (a fatty acid ester-based oil and a polyoxyethylene-based surfactant), distilled water, and DMSO were introduced so that the finishing oils and DMSO were impregnated into the yarns. The yarns were then dried at 140° C., drawn to two times, and subjected to a 20% relaxation treatment at 160° C. to obtain acrylic fibers having a single fiber fineness of about 46 dtex. In the oil bath, 0.85 parts by weight of DMSO was added with respect to 100 parts by weight of the oil solution (the total weight of the fatty acid ester-based oil, polyoxyethylene-based surfactant, and distilled water).

Example 2

Acrylic fibers of Example 2 having a single fiber fineness of about 46 dtex were produced in the same manner as in Example 1 except that a mixture containing 1.0 part by weight of DMSO with respect to 100 parts by weight of the oil solution was introduced into the oil bath.

Example 3

Acrylic fibers of Example 3 having a single fiber fineness of about 46 dtex were produced in the same manner as in Example 1 except that a mixture containing 1.2 parts by weight of DMSO with respect to 100 parts by weight of the oil solution was introduced into the oil bath.

Example 4

Acrylic fibers of Example 4 having a single fiber fineness of about 46 dtex were produced in the same manner as in Example 1 except that a mixture containing 1.0 part by weight of dimethylsulfone with respect to 100 parts by weight of the oil solution was introduced into the oil bath.

Example 5

Acrylic fibers of Example 5 having a single fiber fineness of about 46 dtex were produced in the same manner as in Example 1 except that a mixture containing 1.0 part by weight of ethylene carbonate with respect to 100 parts by weight of the oil solution was introduced into the oil bath.

Example 6

Acrylic fibers of Example 6 having a single fiber fineness of about 46 dtex were produced in the same manner as in Example 1 except that a mixture containing 1.0 part by weight of sulfolane with respect to 100 parts by weight of the oil solution was introduced into the oil bath.

Example 7

An acrylic polymer consisting of 46 wt % of acrylonitrile, 52 wt % of vinyl chloride, and 2 wt % of sodium styrenesulfonate was dissolved in N,N-dimethylformamide (DMF) to prepare a spinning solution with a resin concentration of 28.0 wt % and a moisture concentration of 3.5 wt %. The spinning solution was extruded into a 20° C. coagulation bath containing 62 wt % of a DMF aqueous solution using a spinning nozzle (pore diameter: 0.3 mm, the number of pores: 1250) and subjected to wet spinning at a spinning rate of 2 m/minute, followed by drawing to 3 times in a 80° C. drawing bath containing 50 wt % of a DMF aqueous solution. Then, the primary drawn yarns were washed with warm water at 90° C. Next, the water-washed primary drawn yarns were immersed for 3 to 5 seconds in an oil bath (60° C.) into which a mixture of finishing oils (a fatty acid ester-based oil and a polyoxyethylene-based surfactant), distilled water, and dimethylsulfone were introduced so that the finishing oils and dimethylsulfone were impregnated into the yarns. The yarns were then dried at 140° C., drawn to two times, and subjected to a 20% relaxation treatment at 160° C. to obtain acrylic fibers having a single fiber fineness of about 46 dtex. In the oil bath, 1.00 parts by weight of dimethylsulfone was added with respect to 100 parts by weight of the oil solution (the total weight of the fatty acid ester-based oil, polyoxyethylene-based surfactant, and distilled water).

Example 8

An acrylic polymer consisting of 46 wt % of acrylonitrile, 52 wt % of vinyl chloride, and 2 wt % of sodium styrenesulfonate was dissolved in dimethylacetamide (DMAc) to prepare a spinning solution with a resin concentration of 28.0 wt % and a moisture concentration of 3.5 wt %. The spinning solution was extruded into a 20° C. coagulation bath containing 62 wt % of a DMAc aqueous solution using a spinning nozzle (pore diameter: 0.3 mm, the number of pores: 1250) and subjected to wet spinning at a spinning rate of 2 m/minute, followed by drawing to 3 times in a 80° C. drawing bath containing 50 wt % of a DMAc aqueous solution. Then, the primary drawn yarns were washed with warm water at 90° C. Next, the water-washed primary drawn yarns were immersed for 3 to 5 seconds in an oil bath (60° C.) to which a mixture of finishing oils (a fatty acid ester-based oil and a polyoxyethylene-based surfactant), distilled water, and dimethylsulfone were introduced so that the finishing oils and dimethylsulfone were impregnated into the yarns. The yarns were then dried at 140° C., drawn to two times, and subjected to a 20% relaxation treatment at 160° C. to obtain acrylic fibers having a single fiber fineness of about 46 dtex. In the oil bath, 1.00 parts by weight of dimethylsulfone was added with respect to 100 parts by weight of the oil solution (the total weight of the fatty acid ester-based oil, polyoxyethylene-based surfactant, and distilled water).

Comparative Example 1

Acrylic fibers of Comparative Example 1 having a single fiber fineness of about 46 dtex were produced in the same manner as in Example 1 except that only the oil solution was introduced into the oil bath.

Comparative Example 2

Acrylic fibers of Comparative Example 2 having a single fiber fineness of about 46 dtex were produced in the same manner as in Example 1 except that a mixture containing 1.0 part by weight of acetyl tributyl citrate (ATBC) with respect to 100 parts by weight of the oil solution was introduced into the oil bath.

Comparative Example 3

An acrylic polymer consisting of 46 wt % of acrylonitrile, 52 wt % of vinyl chloride, and 2 wt % of sodium styrenesulfonate was dissolved in dimethylsulfoxide (DMSO) to prepare a resin solution with a resin concentration of 28.0 wt % and a moisture concentration of 3.5 wt %. Next, 3 parts by mass of dimethylsulfone with respect to 100 parts by mass of the acrylic polymer was added to the resin solution to prepare a spinning solution. Acrylic fibers of Comparative Example 3 having a single fiber fineness of about 46 dtex were produced in the same manner as in Comparative Example 1 except that said spinning solution was used.

The hot water setting properties of the acrylic fibers of Examples 1-6 and Comparative Examples 1-3 were evaluated as below, and Table 1 below shows the results. The contents of the organic solvent A in the acrylic fibers of Examples 1-6 and Comparative Examples 1-3 were measured as below, and Table 1 shows the results. The peak temperatures of tan δ of the acrylic fibers of Examples 1-6 and Comparative Examples 1-3 were measured as below, and Table 1 shows the results.

(Curl Setting Properties with Hot Water)

The acrylic fibers (the total fineness: 7400 dtex) were cut into 27 cm long, and a fiber bundle obtained was fixed to a pipe (diameter: 15 mm) by winding the bundle around the pipe. The pipe was immersed in hot water at 70° C. for 15 seconds, followed by standing and drying at room temperature. The length of the fiber bundle directly after removal from the pipe was measured. The shorter the length of the fiber bundle, the better the curl setting properties with hot water (HWS properties).

(Content of the Organic Solvent A in the Acrylic Fiber)

Fibers were put in a glass sample bottle filled with pure water so that the water would not overflow, and left to stand for 2 hours or more in hot water at 95° C. or more. After extraction of the organic solvent in the fibers, the extract was analyzed with gas chromatography to calculate a weight (W1) of the organic solvent in the fibers. The fibers in the glass sample bottle were washed with pure water, and dried in an atmosphere at 110° C. for 4 hours or more to measure a weight (W2) of the fibers after drying. The content of the organic solvent A in the acrylic fibers was calculated from the following formula.

$$\text{The content of the organic solvent } A \text{ in the acrylic fibers (wt \%)} = (W1)/(W2+W1)\times 100$$

(Peak Temperature of Tan δ)

A loss modulus (E") and a storage modulus (E') of the fibers were measured in accordance with JIS K 7244 under the conditions of a frequency of 0.05 Hz, a load of 25 mN±10 mN, and a temperature increase rate of 5° C./min using a thermal analysis device (model "SSC/5200" manufactured by Seiko Instruments Inc.) so as to calculate a dynamic viscoelasticity (tan δ) by the formula below. A temperature at which the dynamic viscoelasticity (tan δ) became maximum was determined as a peak temperature of tan δ (apparent Tg).

$$\text{Dynamic viscoelasticity (tan } \delta) = \text{Loss modulus } (E'')/\text{Storage modulus } (E')$$

TABLE 1

| | Organic solvent A | The content of organic solvent A in fiber (wt %) | Apparent Tg (° C.) | HWS properties Length of fiber bundle after hot water setting at 70° C. (cm) |
|---|---|---|---|---|
| Ex. 1 | DMSO | 0.44 | 91.2 | 15.3 |
| Ex. 2 | DMSO | 0.84 | 88.1 | 14.8 |
| Ex. 3 | DMSO | 1.05 | 86.8 | 13.8 |
| Ex. 4 | Dimethylsulfone | 0.42 | 86.9 | 13.7 |
| | DMSO | 0.03 | | |
| Ex. 5 | Ethylene carbonate | 0.36 | 87.0 | 13.5 |
| | DMSO | 0.03 | | |
| Ex. 6 | Sulfolane | 0.45 | 88.6 | 13.8 |
| | DMSO | 0.02 | | |
| Ex. 7 | Dimethylsulfone | 0.50 | 86.8 | 13.6 |
| | DMF | 0.02 | | |
| Ex. 8 | Dimethylsulfone | 0.54 | 86.6 | 13.4 |
| | DMAc | 0.03 | | |
| Comp. Ex. 1 | DMSO | 0.09 | 95.9 | 16.1 |

TABLE 1-continued

| | Organic solvent A | The content of organic solvent A in fiber (wt %) | Apparent Tg (° C.) | HWS properties Length of fiber bundle after hot water setting at 70° C. (cm) |
|---|---|---|---|---|
| Comp. Ex. 2 | ATBC | Undetectable | 96.1 | 15.9 |
| Comp. Ex. 3 | Dimethylsulfone DMSO | Undetectable 0.05 | 95.9 | 15.9 |

*Ex.: Example,
Comp. Ex.: Comparative Example

As can be seen from the results of Table 1 above, the acrylic fibers of Examples 1-8 containing the organic solvent A in an amount of 0.1 wt % or more resulted in a shorter fiber bundle after hot water setting at 70° C. and exhibited better HWS properties than the acrylic fibers of Comparative Example 1 containing the organic solvent A in an amount of less than 0.1 wt %.

The acrylic fibers of Examples 1-8 had a lower peak temperature of tan δ (apparent Tg) than the acrylic fibers of Comparative Example 1. It is considered that such a lowered peak temperature of tan δ (apparent Tg) in the acrylic fibers of Examples contributed to the improvement in the HWS properties. This effect is different from the effect of improving the opacity of acrylic fibers by adjusting tan δ as described in JP 2003-328222 A.

It is considered that, in the acrylic fibers of Examples, the organic solvent A produced an effect of plasticizing the acrylic polymer and thereby lowering the peak temperature of tan δ (apparent Tg) of the acrylic fibers. The result of Comparative Example 2 shows that acetyl tributyl citrate, which is conventionally used as a plasticizer, was not impregnated into the acrylic fibers, and hence the peak temperature of tan δ (apparent Tg) of the acrylic fibers was high and the HWS properties were poor. It is considered that, in one or more embodiments of the present invention, by having the acrylic fibers containing 01 to 3 wt % of the organic solvent A such as dimethylsulfoxide, dimethylsulfone, ε-caprolactam, ethylene carbonate, or sulfolane, which is different from a conventional plasticizer, the effect of plasticizing the acrylic polymer is obtained without largely changing the polymer composition of the acrylic fibers. The result of Comparative Example 1 shows that, in the case of using the spinning solution prepared by dissolving the acrylic polymer in the organic solvent A (DMSO), most of the organic solvent A in the spinning solution was eluted into the spinning bath. As a result, the content of the organic solvent A in the acrylic fibers became less than 0.1 wt %, and hence the peak temperature of tan δ of the acrylic fibers was high and the HWS properties were low. The result of Comparative Example 3 shows that, even if another organic solvent A was added to the spinning solution prepared by dissolving the acrylic polymer in the organic solvent (DMSO), most of the organic solvent A used for dissolving the acrylic polymer and all of the another organic solvent A were eluted into the spinning bath. As a result, the content of the organic solvent A in the acrylic fibers was less than 0.1 wt %, and the peak temperature of tan δ of the acrylic fibers was high and the HWS properties were low.

Although the disclosure has been described with respect to only a limited number of embodiments, those skilled in the art, having benefit of this disclosure, will appreciate that various other embodiments may be devised without departing from the scope of the present invention. Accordingly, the scope of the present invention should be limited only by the attached claims.

What is claimed is:

1. An acrylic fiber for artificial hair, comprising an acrylic polymer and an organic solvent that can dissolve the acrylic polymer, wherein the acrylic polymer comprises, with respect to a total weight of the acrylic polymer, 29.5 to 79.5% by weight of acrylonitrile, 20 to 70% by weight of vinyl chloride and/or vinylidene chloride, and 0.5 to 5% by weight of a sulfonic acid-containing vinyl monomer, wherein a content of the organic solvent in the acrylic fiber is 0.1 to 3% by weight, and wherein the acrylic fiber has a single fiber fineness of 30 to 100 dtex.

2. The acrylic fiber for artificial hair according to claim 1, wherein the organic solvent is at least one selected from the group consisting of acetone, dimethylsulfoxide, N,N-dimethylformamide, dimethylacetamide, dimethylsulfone, ε-caprolactam, ethylene carbonate, and sulfolane.

3. A method for producing an acrylic fiber for artificial hair, the method comprising:

extruding a spinning solution through a spinning nozzle to form a yarn;

drawing the yarn to prepare a primary drawn yarn and washing it with water; and impregnating the water-washed primary drawn yarn with an organic solvent that can dissolve the acrylic polymer so that a content of the organic solvent in the acrylic fiber is 0.1 to 3% by weight, wherein the spinning solution comprises an acrylic polymer comprising, with respect to a total weight of the acrylic polymer, 29.5 to 79.5% by weight of acrylonitrile, 20 to 70% by weight of vinyl chloride and/or vinylidene chloride, and 0.5 to 5% by weight of a sulfonic acid-containing vinyl monomer, and wherein the acrylic fiber has a single fiber fineness of 30 to 100 dtex.

4. The method for producing an acrylic fiber for artificial hair according to claim 3, wherein the impregnating the water-washed primary drawn yarn is performed using a mixture of the organic solvent that can dissolve the acrylic polymer and a finishing oil.

5. The method for producing an acrylic fiber for artificial hair according to claim 3, wherein the spinning solution is obtained by dissolving the acrylic polymer in one organic solvent selected from the group consisting of acetone, dimethylsulfoxide, N,N-dimethylformamide, and dimethylacetamide.

6. The method for producing an acrylic fiber for artificial hair according to claim 5, wherein the extruding is performed by extruding the spinning solution into a coagulation liquid through the spinning nozzle; and wherein the drawing is performed by drawing the yarn in an aqueous solution of the organic solvent used for the spinning solution.

7. A hair ornament product comprising the acrylic fiber for artificial hair according to claim 1.

8. The hair ornament product according to claim 7, wherein the hair ornament product is at least one selected from the group consisting of a fiber bundle for hair, a weave, a wig, a braid, a toupee, a hair extension, and a hair accessory.

* * * * *